US006851916B2

(12) United States Patent
Schmidt

(10) Patent No.: US 6,851,916 B2
(45) Date of Patent: Feb. 8, 2005

(54) COUPLING ASSEMBLY

(75) Inventor: Larry W. Schmidt, Farmington, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 10/264,465

(22) Filed: Oct. 4, 2002

(65) Prior Publication Data

US 2004/0067126 A1 Apr. 8, 2004

(51) Int. Cl.[7] ..... E02F 3/28
(52) U.S. Cl. ..... 414/723; 37/468; 403/323
(58) Field of Search ..... 414/723; 37/468, 37/321; 403/323, 324, 325; 292/58, 61

(56) References Cited

U.S. PATENT DOCUMENTS

| | | | | |
|---|---|---|---|---|
| 3,984,016 A | | 10/1976 | Kuhn | 214/131 A |
| 4,085,856 A | | 4/1978 | Westendorf | 214/145 A |
| 4,119,225 A | | 10/1978 | Macht et al. | 214/145 A |
| 4,488,850 A | | 12/1984 | Wernimont | 414/723 |
| 4,812,103 A | | 3/1989 | Cochran et al. | 414/723 |
| 5,253,904 A | * | 10/1993 | Ruby | 292/58 |
| 5,836,734 A | | 11/1998 | Doering | 414/723 |
| 6,390,765 B1 | | 5/2002 | Dick | 414/723 |

OTHER PUBLICATIONS

"Comparison of Invention of Prior Art", 3 pages, dated Oct. 31, 2002.
Operation, 1 page, dated Oct. 31, 2002.
Ramrod Taskmaster Series "A Mini–Skid For Any Task", 6 pages, undated.
Kanga Loaders, 4 pages, undated.
Power House "Prodigy", 4 pages, undated.
Bobcat "463 Compact Skid–Steer Loader", 4 pages, undated.
Case "Skid Steer Attachment Guide", 16 pages, 1996.
Gehl "Skid Loaders", 8 pages, 1994.
New Holland Super Boom "Skid–Steer Loader Attachments", 8 pages, 1995.
Thomas "What Makes Thomas So Though?", 3 pages, undated.
Thomas "95", 5 pages, undated.
Hyundai "HSL 610, HSL 810 Skid Steer Loaders", 4 pages, undated.

* cited by examiner

*Primary Examiner*—Donald W. Underwood
(74) *Attorney, Agent, or Firm*—Fulbright & Jaworski LLP

(57) ABSTRACT

An improved coupling assembly and method of use are disclosed herein to include a tool carrier attached to a utility loader or other work vehicle and supporting a pin guide. A pin is supported upon the carrier by the pin guide and interacts with one or more cam surfaces supported by the carrier. During axial rotation of the pin, the cam surface transfers a force to the pin to assist in the extraction and/or retraction of the pin into the implement. In one embodiment, the pin has a user graspable handle which may be rotated and axially moved by an operator. A visual indication that the pin is not fully engaged with the implement is also provided. Additionally, a locking mechanism is provided which prevents a pin from disengagement with the implement.

25 Claims, 8 Drawing Sheets

COUPLING ASSEMBLY

TECHNICAL FIELD

The present invention relates to vehicles having lift arms such as skid-steer loaders, and more particularly to a quick attach device for releasably connecting a variety of working implements with a carrier mounted to the lift arms of such vehicles.

BACKGROUND OF THE INVENTION

Working vehicles such as skid-steer loaders or other small utility loaders have lift arms that can be used with various work implements such as buckets, blades, and lift forks. Various mechanisms have been proposed to provide quick interchange of the work implements so the same loader can be used for different work functions.

Working vehicles frequently have tool carriers supported at the end of their lift arms. These carriers are adapted to be attached to a variety of implements. To simplify and expedite the mounting and removal of various implements, the carriers are equipped with quick-attach devices. The carrier and/or quick-attach devices typically include positioning structures to orient and locate one part of the carrier relative to the implement as well as a latching structure to secure the implement to the carrier.

Some quick-attach mechanisms rely on pins which must be inserted into aligned holes in the implement. This type of mechanism can require careful and time consuming alignment of the pins and holes. Additionally, dirt or other obstructions may make insertion and removal of the pins somewhat difficult. It would be desirable to visually inform the operator of the existence of a misalignment or non-engagement of the pin with the implement. Additionally, it would be desirable to provide some mechanical advantage to assist in engaging the pin with the implement, such as during a misalignment condition.

Accordingly, it would be desirable to provide a coupling assembly which avoids deficiencies in the prior art and is easy to use and provides for efficient releasable coupling of an implement to a working vehicle.

SUMMARY OF THE INVENTION

Accordingly, it would be desirable to provide a coupling assembly which avoids deficiencies in the prior art and is easy to use and provides for efficient releasable coupling of an implement to a working vehicle.

Toward these ends, there is broadly provided a coupling assembly including a tool carrier attached to the work vehicle and supporting a pin guide. A pin is supported upon the carrier by the pin guide and interacts with one or more cam surfaces supported by the carrier. During rotation of the pins, the cam surfaces transfer an axial force to the pin to assist in the extraction or insertion of the pins into the implement. In one embodiment, the pin has a graspable handle which may be rotated and axially moved by an operator. As a result, the pin and cam surfaces cooperate to convert a rotational motion of the pin handle into a linear motion assisting in the extension of the pin into its engaged position within an implement aperture or in the retraction of the pin into its disengaged position so that implement may be removed.

The cam surface which engages the pin may be provided upon a small insert or upon the guide block or both. In one embodiment, two cam surfaces are provided so that axially forces may be transferred to the pin to assist in both the extraction and insert of the pin relative to the implement.

In a preferred embodiment of this invention, the improved coupling assembly includes a carrier supporting a pair of similar pin assemblies, each as described above.

One object of the present invention is the provision of a visual indication that the pin is not fully engaged with the implement. An operator may visually reference the pin assembly to determine that the pin is properly engaged with the implement.

Yet another object of the present invention is the provision of a locking mechanism which prevents a pin from disengagement under axial-only force. As described herein, to disengage the pin from the implement an axial and rotation force must be applied.

These and other objects, features, and advantages of the invention will be evident from the following description of the preferred embodiment of this invention, with reference to the accompanying drawings.

DETAILED DESCRIPTION OF THE PREFERRED EMBODIMENTS

Figure 1:
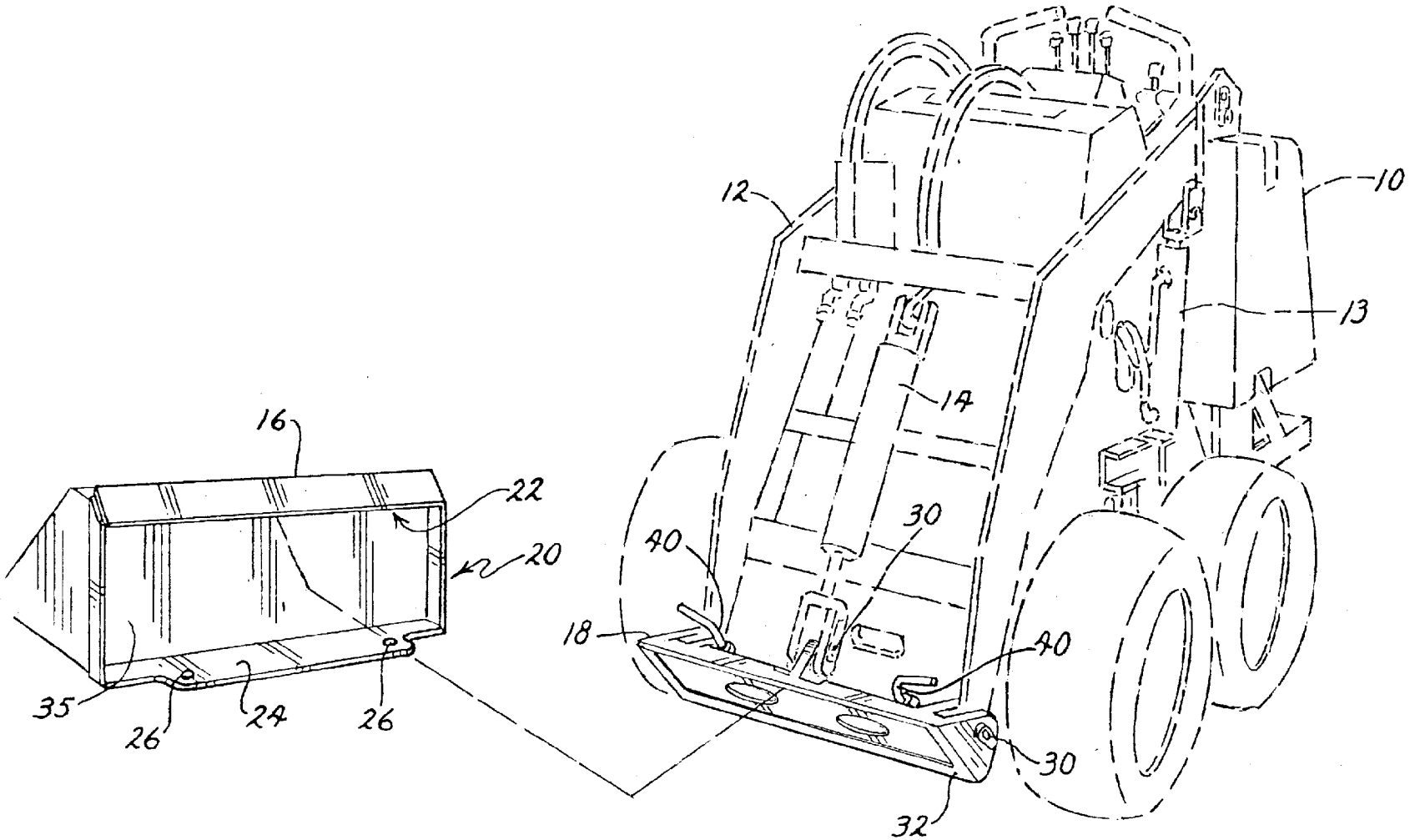
FIG. 1 is a perspective view of a working vehicle having an implement carrier according to the present invention and positioned relative to an implement.

While this invention can be embodied in many different forms, there is shown in the drawings and described in detail, a preferred embodiment of the invention. The present disclosure is to be considered as an exemplification of the principles of the invention and is not intended to limit the invention to the embodiment illustrated.

For ease of description, the coupling assembly embodying this invention will be described in a normal upright operating position and such terms as upper, lower, upwardly, downwardly, will be used with reference to this position. It will be understood, however, that the coupler assembly embodying this invention can be used in an orientation other than the position described.

Referring to the Figures, a tractor or utility loader 10 having a lift arm assembly 12 and dump cylinder 14, and commonly referred to as a skid steer loader, is shown in association with a work implement 16, a bucket. The illustrated tractor 10 is a DINGO brand compact utility loader manufactured by The Toro Company. As described in more detail herein, a carrier 18 engages implement 16. Alternative tractors 10 or utility loaders may utilize a coupling assembly according to the present invention.

The present invention, a coupling assembly, can be used with other mechanized equipment having a lift arm assembly and can be used to couple a variety of implement such as a bucket, blade, or fork assembly, etc. to a carrier of a machine. The term "carrier" is meant to broadly cover an intermediate structure between a loader 10 and an implement 16. Typical carriers 18 are movably connected to lift arms 12 of loader 10 so that implement 16 may be raised or lowered by lift cylinders 13 attached between lift arms 12 and a frame of loader 10. A variety of carriers 18 could be utilized to practice the present invention. Alternative carriers 18 may not have a "plate-like" structure 32 for engaging implement 16, but instead may have a plurality of contact points between carrier 18 and implement 16.

Implement 16 is provided with an attachment structure 20 which includes a downwardly facing recess 22 and an upwardly facing member 24 having a pair of apertures 26 for engaging tractor 10. Attachment structure 20 is designed to cooperate with carrier 18 as further described herein to facilitate alignment and connection between the elements. Various implements, such as a bucket, auger, loading forks and the like having associated attachment structure 20 can be connected to carrier 18.

Figure 2:
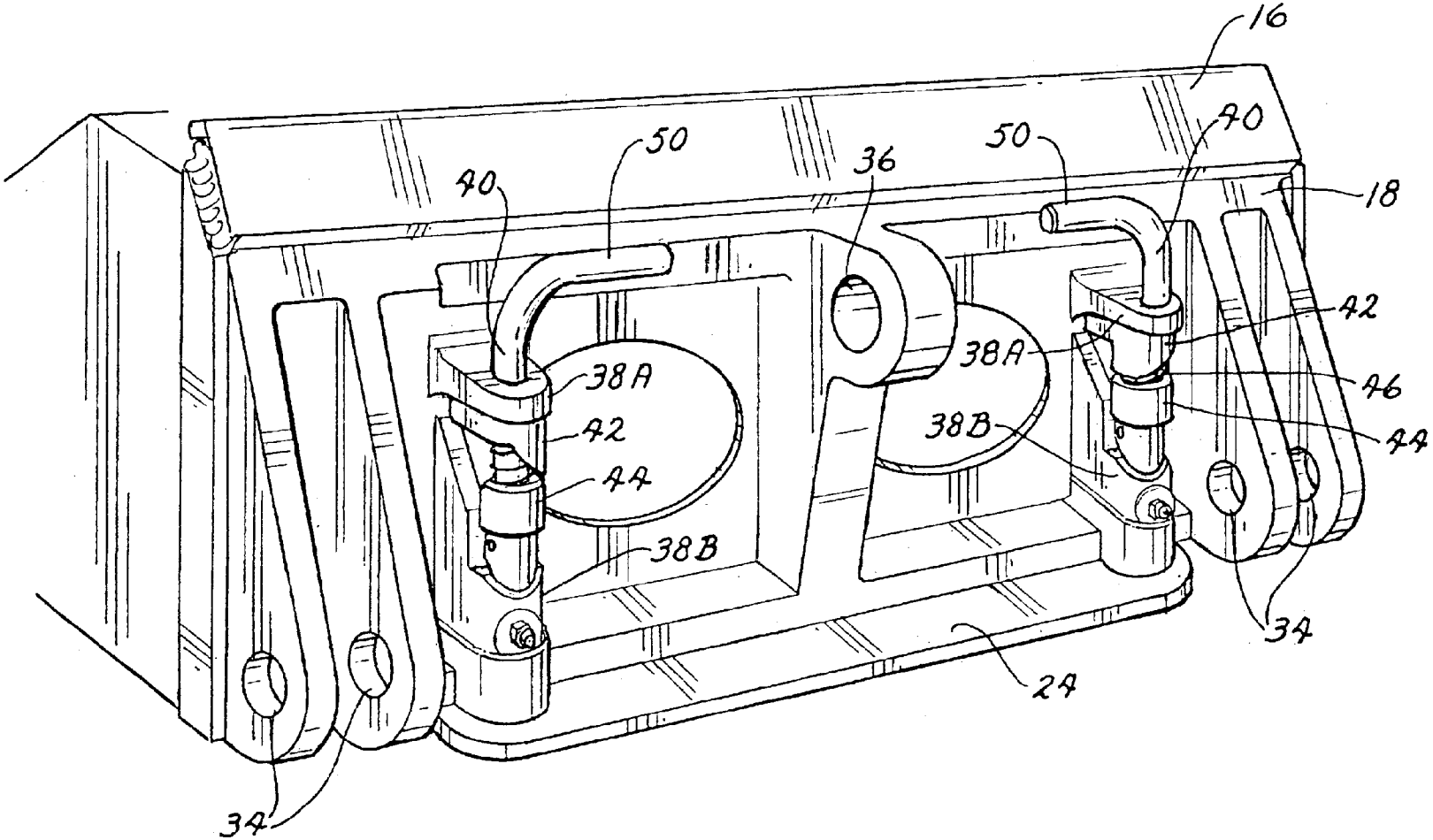
FIG. 2 is a perspective view of an implement and carrier according to the present invention, wherein the pin assembly is illustrated in an engaged orientation.

Referring to FIGS. 1 and 2, carrier 18 is attached to lift arm assembly 12 with 3 pins 30, (2 pins are shown in FIG. 1). Carrier 18 includes a plate surface 32 for engaging a generally flat surface 34 of implement 16. Pins 30 pass through appropriately sized apertures 35, 36 upon carrier 18. Dump cylinder 14 is connected at an upper aperture 36, allowing carrier 18 to pivot in operation relative to lower pins 30. Carrier 18 further includes a plurality of guide block structures 38A, 38B for slidably receiving a pair of pins 40 of the coupling structure of the present invention. Guide block structures 38A, 38B include a pair of upper guides 38A and a pair of lower guides 38B.

Carrier 18 is selectively connected to attachment structure 20 of implement 16 through the coupling assembly of the present invention. As described herein, the coupling assembly of the present invention provides a selective connection between attachment structure 20 of implement 16 and carrier 18 of loader 10.

In overview, a preferred embodiment of the coupling assembly of the present invention includes a pair of pins 40, upper and lower inserts 42, 44, a spring 46, and upper and lower guide blocks 38A, 38B.

Figure 3:
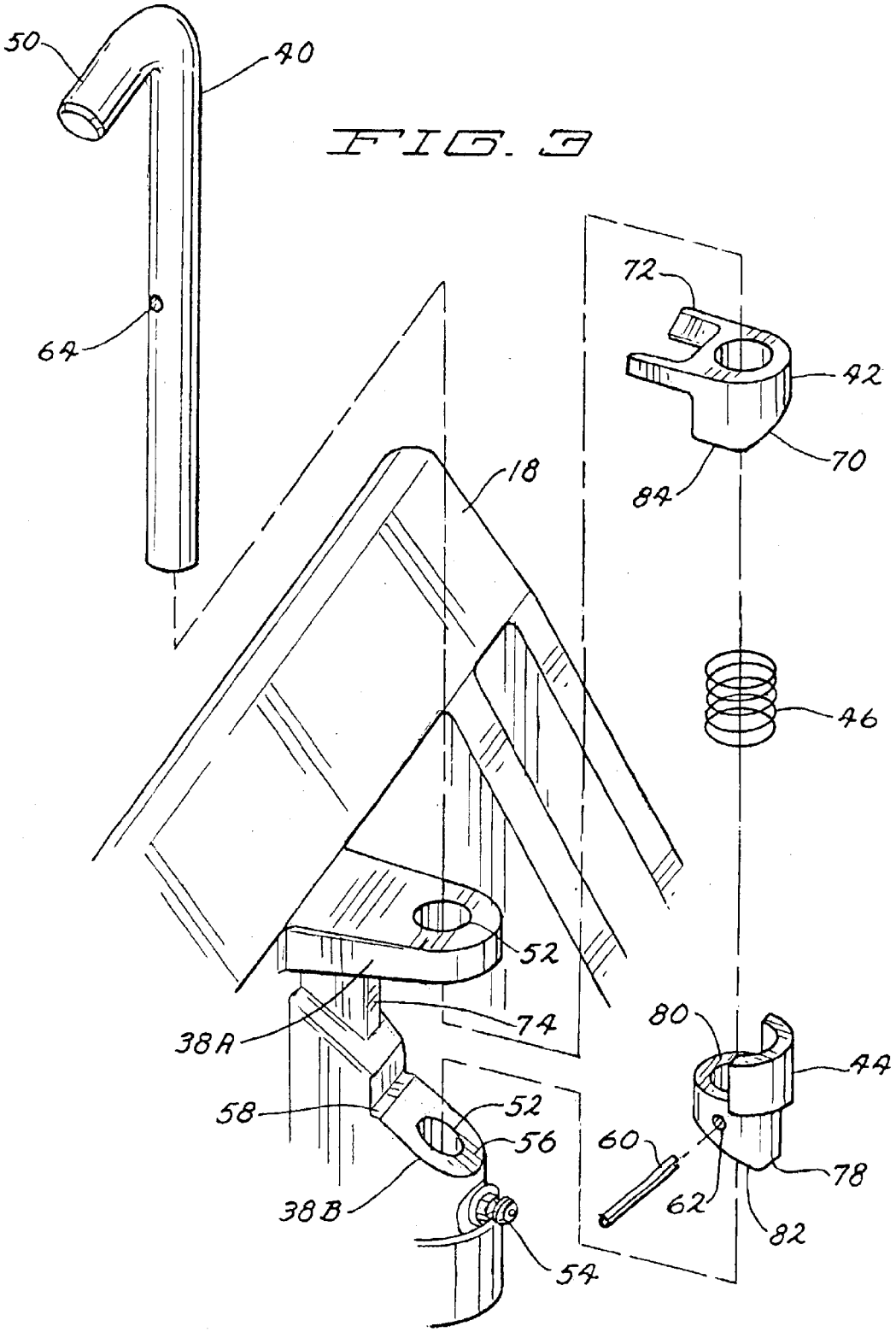
FIG. 3 is a detailed exploded view of a pin assembly and carrier according to the present invention.

Referring particularly to FIG. 3, pin 40 has a handle 50 adapted to be grasped by an operator during a coupling method as described herein. Pin 40 is slidably received within bores 52 of both upper guide 38A and lower guide 38B of mounting frame 18 so that pin 40 may both rotate and translate relative to its longitudinal axis. Lower guide 38B includes a grease fitting 54 permitting lubrication of the coupling assembly.

Lower guide 38B further includes a cam surface 56. A shoulder 58 is positioned at a top portion of cam surface 56. As described hereinafter, cam surface 56 may be engaged by lower insert 44 causing pin 40 to rotate during a coupling operation. In this embodiment, cam surface 56 is an inclined surface which is generally planar. Alternative cam surfaces 56 may include curves or more complex surfaces. As used herein the term "cam surface" means a surface which is at least partially oblique relative to an axis passing through bore 52 centers.

Upper insert 42, spring 46, and lower insert 44 are positioned relative pin 40 between upper guide 38A and lower guide 38B. Inserts 42, 44 and spring 46 are sized to slidably receive pin 40. Lower insert 44 is connected to pin 40 by a small pin 60 passing through an aperture 62 in insert 44 and an aperture 64 in pin 40. As a result, lower insert 44 and pin 40 rotate and move together. Upper insert 42 includes a second cam surface 70. As described herein, second cam surface 70 may be engaged by lower insert 44 causing pin 40 to extend into its engaged position. Upper insert 42 includes a birfucated end 72 which engages a protrusion 74 of carrier 18. Bifurcated end 72 prevents upper insert 42 from rotating relative to pin 40. Spring 46 is compressed during assembly so that spring 46 biases apart inserts 42, 44.

Operation of the coupling assembly may be described with reference to the figures. In overview, attachment and detachment of the implement 16 is made by manually grasping pin handle 50 to engage and retract pin 40 relative to apertures 26 of implement 16.

Figure 4:
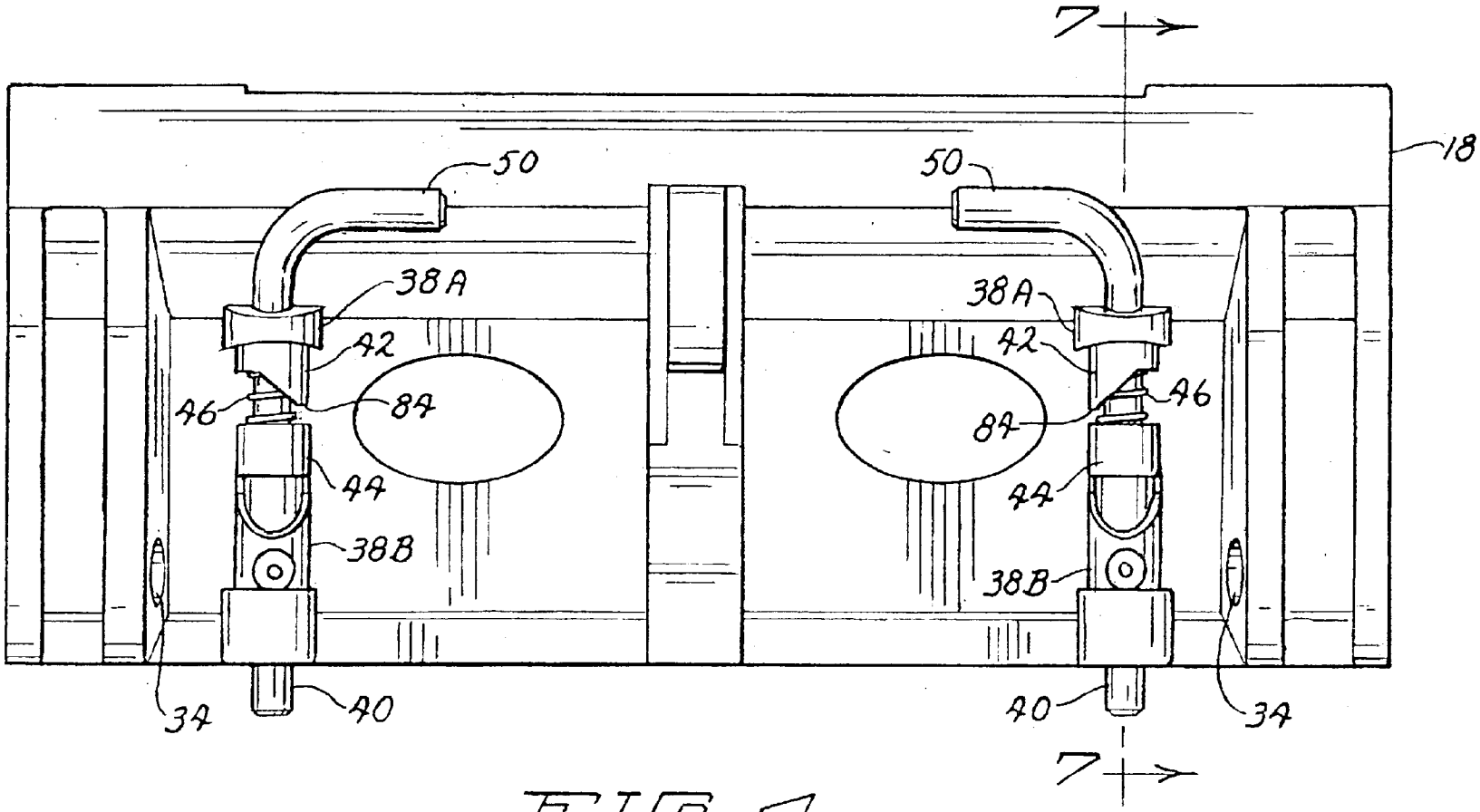
FIG. 4 is an elevational view of a pin assembly and carrier of FIG. 1, illustrating the engaged orientation of the elements.
Figure 6:
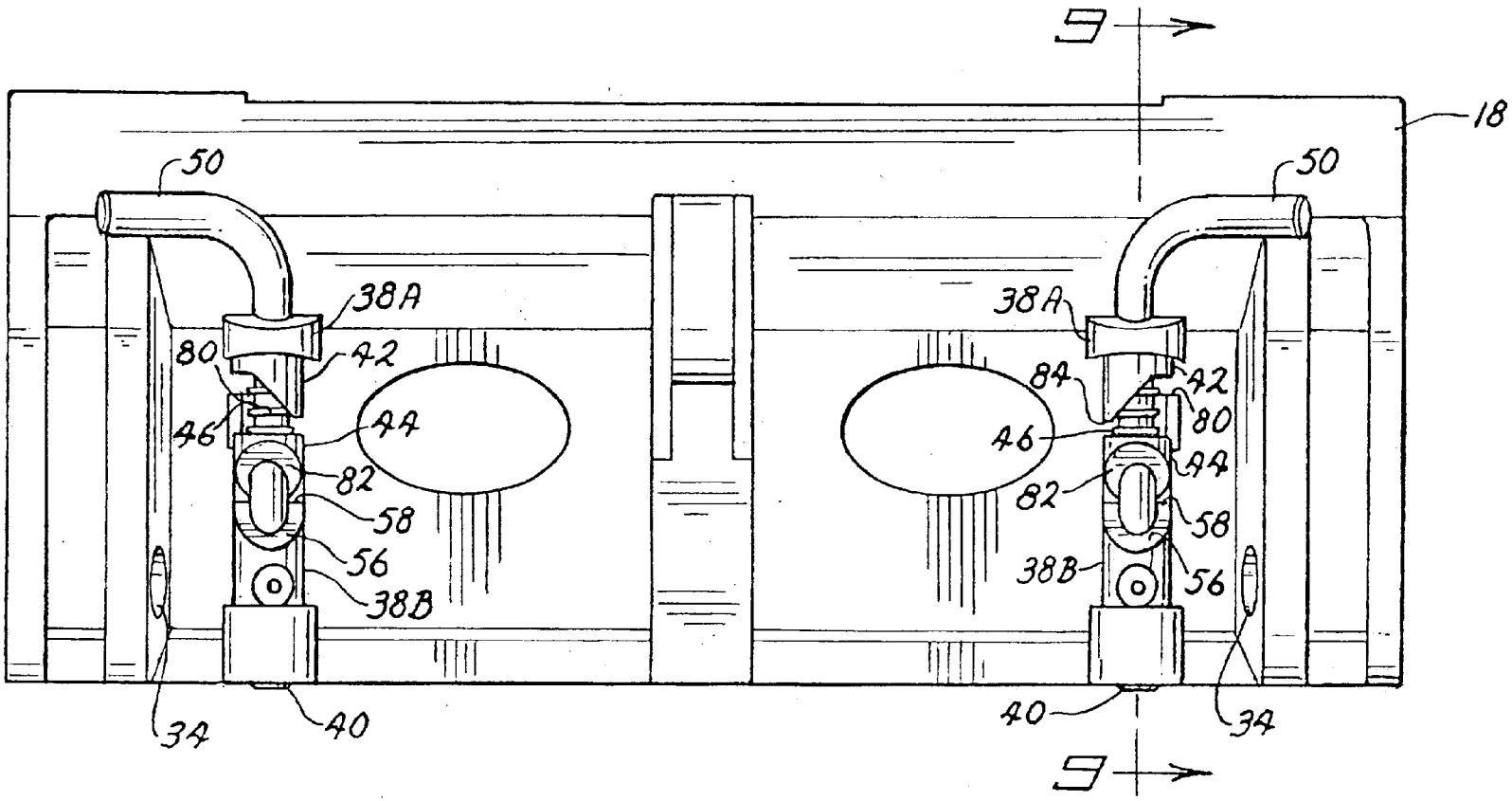
FIG. 6 is an elevational view of a pin assembly and carrier of FIG. 1, illustrating the disengaged orientation of the elements.
Figure 7:
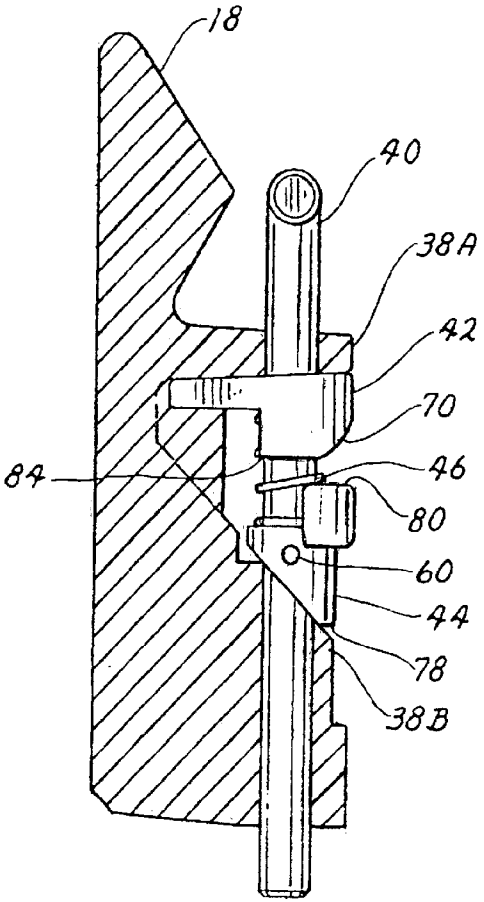
FIG. 7 is a cross-sectional view of the pin assembly and carrier taken along lines 7—7 of FIG. 4.
Figure 9:
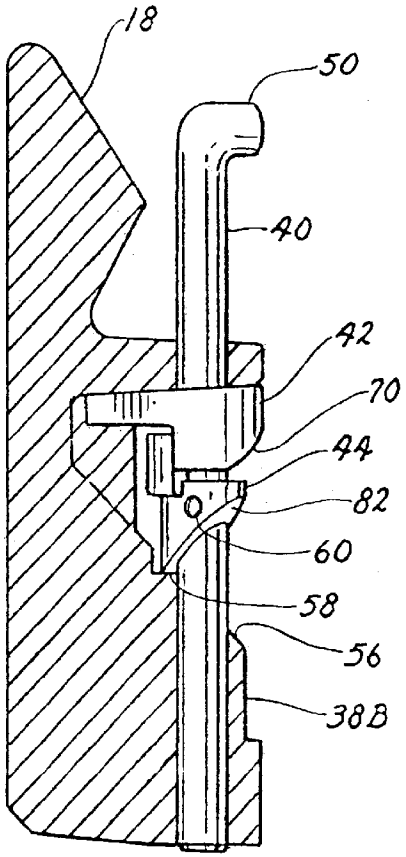
FIG. 9 is a cross-sectional view of the pin assembly and carrier taken along lines 9—9 of FIG. 6.

As depicted in FIG. 1, loader 10 may engage implement 16 by retracting pins 40, tilting carrier 18 relative to implement 16, moving the loader 10 forward, and inserting the upper lip of carrier 18 into the downwardly facing recess 22 of implement 16. FIGS. 1, 6 and 9 illustrate pins 40 in their retracted position. With the upper lip of carrier 18 retained within downwardly facing recess 22, carrier 18 may be rotated by action of cylinder 14 so that the plate surface 32 engages flat surface 35 of implement 16. At this point, pin 40 handles 50 may be rotated to engage pins 40 into apertures 26 of implement 16. FIGS. 2, 4 and 7 illustrate pins 40 in their extended position (implement engaged position).

To remove the implement 16, pin 40 handles 50 are rotated and lifted to retract pins 40 from apertures 26 of implement 16. The implement 16 may then be lowered to the ground and carrier 18 rotated so that the upper lip of carrier 18 is removed downwardly facing recess 22. Additional features of the coupling assembly of the present invention are revealed by closer examination of FIGS. 2 through 7.

Figure 5:
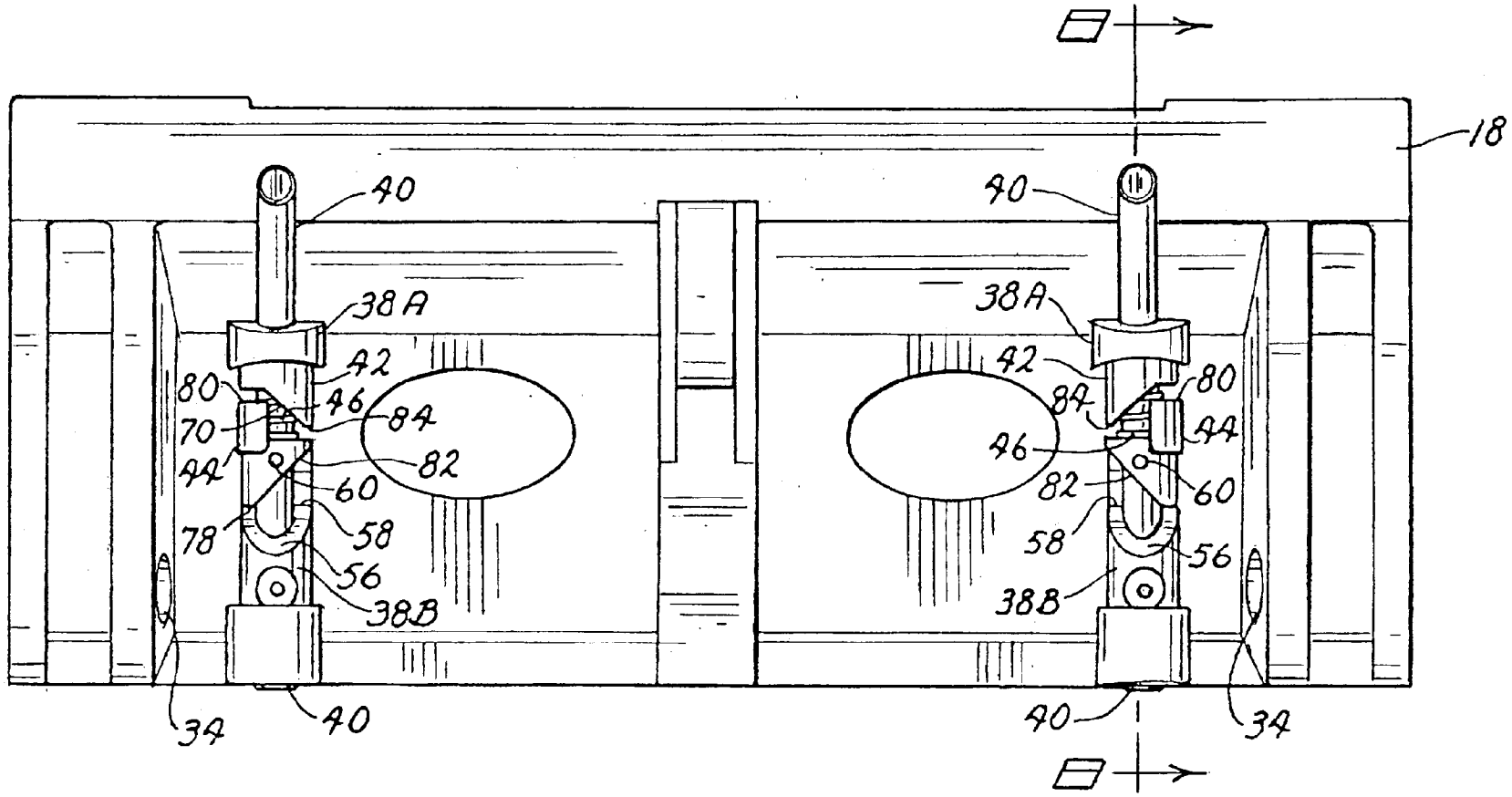
FIG. 5 is an elevational view of a pin assembly and carrier of FIG. 1, illustrating an intermediate orientation of the elements.
Figure 8:
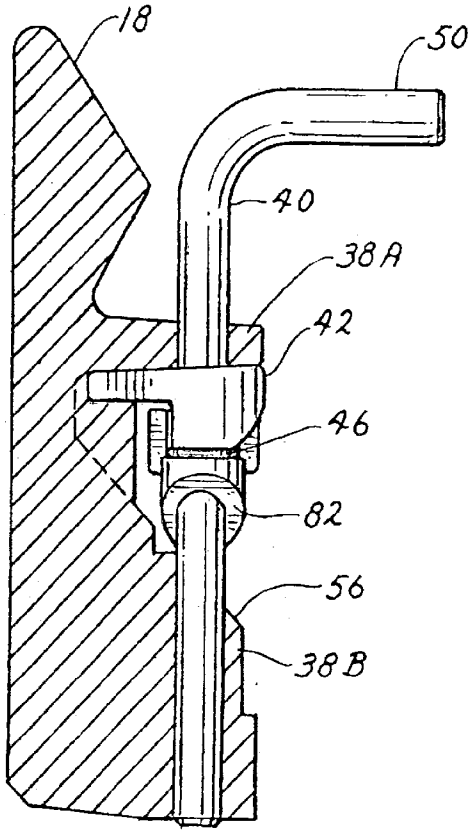
FIG. 8 is a cross-sectional view of the pin assembly and carrier taken along lines 8—8 of FIG. 5.

FIGS. 2–7 illustrate three orientations of pin 40 relative to mounting plate 18. FIGS. 2, 3, 4 and 7 illustrate the coupling assembly in its engaged position, wherein pins 40 are extended from the bottom of carrier 18 and may be engaged with apertures 26 of implement 16 to connect implement 16 to loader 10. FIGS. 5 and 8 illustrate the coupling assembly in an intermediate position with handle 50 partially rotated from an engaged position. Pin 40 in intermediate orientation is not engaged with implement 16. When handle 50 is in the intermediate position of FIGS. 5 and 8, handle 50 provides a visual indication to the operator that pin 40 is not engaged with implement 16. FIGS. 6 and 9 illustrate the coupling assembly in its detached position, wherein pins 40 are retracted within carrier 18 allowing the implement 16 to be detached from loader 10.

To couple implement 16 to carrier 18, pins 40 are each placed into respective retracted positions as illustrated in FIGS. 6 and 9 and carrier 18 is inserted into attachment structure 20 of implement 16, typically by moving loader 10 into engagement with implement 16. In the retracted position, a flat 78 of lower insert 44 fully engages shoulder 58 of lower guide 38B as spring 46 biases upper insert 342 and lower insert 44 apart. Next an operator grasps pin handle 50 and rotates pin 40 toward its engaged orientation. As pin 40 and lower insert 44 are rotated into the intermediate position of FIGS. 5 and 8, a portion of flat 78 engages shoulder 58.

As pins 40 are further rotated past an intermediate position toward an engaged (extended) position, flat 58 may engage cam surface 56 as spring 46 biases inserts 42, 44 apart. Alternatively, if pin assembly is dirty or a lower aperture is partially blocked or misaligned with aperture 26 of implement 16 an upper portion 80 of lower insert 44 may engage second cam surface 70 so that as pin 40 is rotated, a downward force is transferred through second cam surface 70 to insert 44 forcing pin 40 to align with implement aperture 26 and extend thereinto.

In this manner, a positive alignment and engagement between pin 40 and implement aperture 26 is provided when pin 40 is rotated from its disengaged position into its engaged position. In the absence of second cam surface 70, pin handle 50 could be rotated into its engaged position without pin 40 extending into position within implement aperture 26. The pin 40, lower insert 44, and second cam surface 70 cooperate to convert a rotational motion of handle 50 into a linear motion assisting in the extension of pin 40 into its engaged position within implement aperture 26.

If pin 40 is blocked or misaligned relative to apertures 26, the operator will be prevented from further rotating pin handle 50 toward the engaged orientation of FIGS. 2, 3, 4 and 7 as upper surface 80 of lower insert 44 engages and is blocked by cam surface 70 of upper insert 42. In this regard, a visual indication may be presented to the operator that a misalignment and non-engagement situation exists. In some situations, upon subsequent alignment of pin 40 with aperture 26 (such as upon rocking the implement, etc.), spring 46 may bias insert 44 causing pin 40 to rotate into its engaged orientation. An operator may visually monitor the pin 40 transition from an intermediate non-engaged position to the engaged position, and may facilitate the transition by manipulating the implement 16 (manually or through operation of dump cylinder 14 and/or lift cylinder 13) so that pin 40 aligns with aperture 26.

Regarding the engaged position, as illustrated in FIGS. 2, 3, 4 and 7, an inclined surface 82 of lower insert 44 fully engages cam surface 56. Pin 40 is prevented from substantially displacing in an axial direction, e.g., upwardly, as an upper surface 80 of the lower insert 44 engages and is blocked by a lower surface 84 of the upper insert 42 upon slight axial movement. This provides a positive lock mechanism which prevents pin 40 from axially displacing when in its engaged position. As a result, forces transferred in an upward axial direction at the pin 40 bottom or upward axial forces alone at the handle 50 will not disengaged pin 40 from its engaged position. As described hereinafter, handle 50 must be both axially lifted and rotated to retract pin 40 into carrier 18.

To disengage implement 16 from carrier 18, pin handle 50 is grasped and rotated. Pin 40 may be upwardly lifted by the operator as pin handle 50 is rotated. Alternatively, in the absence of an upward force by the operator, lower insert 44 positively engages cam surface 56 as the pin handle 50 is rotated to cause an upward force retracting pin 40. In this manner, as pin handle 50 is rotated, cam surface 56 may provide an upward force to assist in the retraction of pin 40 from implement aperture 26. The pin 40, lower insert 44, and cam surface 56 cooperate to convert a rotational motion of the handle 50 into a linear motion assisting in the retraction of pin 40 into its disengaged position.

Those skilled in the relevant arts will appreciate that a variety of connections may be utilized to connect carrier 18 to lift arm assembly 12. Additionally, a variety of differently configured attachment structures 20 and carrier 18 may be utilized in conjunction with the coupling assembly of the present invention. For example, a different attachment structure may include a pair of flange structures, each for separately engaging one of a pair of upper lips of a carrier.

Other alternatives to the illustrated embodiment may include forming the second cam surface 70 not on a separate upper insert 42, but instead as a portion of carrier 18, e.g. a machined second cam surface being integral with carrier 18. Lower insert 44 may be formed as an integrated part of pin 40. The lower insert 44 features of an upper surface 80 to engage the second cam surface 70 and a lower surface 82 to engage the first cam surface 56 may be formed into a single pin, rather than a two-piece pin and insert 42, 44 of the illustrated embodiment. For example, a pin 40 may have one or more weldment or other protrusion which engage cam surfaces 56, 70 causing the pin to extend or retract as the pin is rotated. Yet other pins (not shown) for engaging cam surfaces 56, 70 and converting a rotation motion into a linear motion would be practicable.

In another embodiment, handle 50 may be eliminated and a hydraulic or other actuator may be used to provide a rotation motion to a pin 40. The term actuator as used herein means any type of power actuator that provides for extension or retraction under control of an operator. Appropriate linkages between an actuator and a pin 40 would be within the scope of those of ordinary skill in the art. In this regard a positive lock and release mechanism may be provided as the linear motion of the actuator causes pin 40 to rotate and extend or retract in response to engagement with cam surfaces 56, 70.

Various other modifications can be made in the present invention without departing from the scope and spirit of the invention.

What is claimed is:

1. An assembly for selectively coupling an implement to a loader, said assembly comprising:

a carrier supporting a guide;

a pin slidably supported upon the carrier by the guide, an insert attached to the pin; and a first cam surface engaging the insert so that as the pin is rotated in a first direction the first cam surface transfers a force tending to axially extend the pin into engagement with the implement, and a second cam surface engaging the insert so that as the pin is rotated in a second direction opposite the first direction within the guide the second cam surface transfers a force tending to retract the pin from engagement with the implement.

2. An assembly of claim 1 wherein the first cam surface is defined upon a second insert which engages the insert attached to the pin.

3. An assembly of claim 2, wherein the pin is slidably received within the second insert.

4. An assembly of claim 2, wherein the pin is received within an aperture of the second insert and the pin rotates and translates relative to the second insert.

5. An assembly of claim 1 wherein said insert defining a generally oblique surface in contact with the second cam surface.

6. An assembly of claim 1 wherein the pin is received within an aperture of the insert.

7. An assembly of claim 1 wherein the insert contacts both of the first cam surface and the second cam surface.

8. An assembly of claim 1 further comprising a pin handle.

9. An assembly for selectively coupling an implement to a loader, said assembly comprising:

a carrier supporting a guide;

a pin slidably supported upon the carrier by the guide, said pin having a longitudinal axis;

an insert attached to the pin; and a first cam surface engaging the pin so that as the pin is rotated in a first direction about its axis the first cam surface transfers a force tending to axially extend the pin into engagement with the implement, and a second cam surface engaging the insert so that as the pin is rotated in a second direction opposite the first direction about its axis within the guide the second cam surface transfers a force tending to retract the pin from engagement with the implement, and wherein the second cam surface is defined upon a portion of the guide.

10. An assembly of claim 1 wherein the guide comprises an upper guide block and a lower guide block.

11. An assembly for coupling an implement to a loader, said assembly comprising:

a carrier attached to the loader and adapted to be selectively coupled to the implement;

a pin slidably supported upon the carrier between an extended orientation with the pin extending from the carrier and a retracted orientation with the pin retracted from a extended position;

an insert attached to the pin; and a first cam surface supported by the carrier, said first cam surface engaging the pin so that as the pin is rotated in a first direction the first cam surface transfers a force tending to axially move the pin into engagement with the implement, and a second cam surface supported by the carrier, said second cam surface engaging the insert so that as the pin is rotated in a second direction opposite the first direction within the guide the second cam surface transfers a force tending to retract the pin from engagement with the implement.

12. An assembly of claim 11 wherein the first cam surface is defined upon a second insert which engages the pin.

13. An assembly of claim 12 wherein the pin is slidably received within the second insert.

14. An assembly of claim 13 wherein the pin is received within an aperture of the second insert and the pin rotates and translates relative to the second insert.

15. An assembly of claim 11, wherein said insert defining a generally oblique surface in contact with the second cam surface.

16. An assembly of claim 11 wherein the pin is received within an aperture of the insert.

17. An assembly of claim 11 wherein the insert contacts both of the first cam surface and the second cam surface.

18. An assembly of claim 11 further comprising a pin handle.

19. An assembly for coupling an implement to a loader, said assembly comprising:

a carrier attached to the loader and adapted to be selectively coupled to the implement;

a pin slidably supported upon the carrier between an extended orientation with the pin extending from the carrier and a retracted orientation with the pin retracted from an extended position;

a insert attached to the pin; and a first cam surface supported by the carrier, said first cam surface engaging the pin so that as the pin is rotated about its longitudinal axis the first cam surface transfers a force tending to axially move the pin into engagement with the implement, and a second cam surface supported by the carrier, said second cam surface engaging the insert so that as the pin is rotated about its axis within the guide the second cam surface transfers a force tending to retract the pin from engagement with the implement, and wherein the second cam surface is defined upon a portion of the guide.

20. An assembly of claim 19 wherein the guide comprises an upper guide block and a lower guide block.

21. A method of coupling an implement to a utility loader having a carrier, a pin assembly having a pin and an operator graspable handle, said pin being slidably supported upon the carrier between an extended orientation with the pin extending from the carrier and a retracted orientation with the pin retracted from an extended position, said pin being attached to an insert, and at least one cam surface supported by the carrier, said at least one cam surface selectively engaging the insert, said method comprising the steps of:

positioning the implement relative to the carrier;

grasping the handle and rotating the handle in a first direction relative to its longitudinal axis; and engaging the cam surface with the insert so that a force is transferred to the pin which axially moves the pin into engagement with the implement.

22. The method of claim 21 further comprising the steps of:

grasping the handle and rotating the handle in a direction opposite the first direction; and engaging a different cam surface with the insert so that a force is transferred to the pin which axially removes the pin from engagement with the implement.

23. An assembly for selectively coupling an implement to a loader, said assembly comprising:

a carrier;

a pin slidably connected to the carrier by a guide, said pin supporting an oblique surface; and a first cam surface engaging the pin so that as the pin is rotated in a first direction about its axis the first cam surface transfers a force tending to axially extend the pin into engagement with the implement, and a second cam surface engaging the oblique surface so that as the pin assembly is rotated in a second direction opposite the first direction about its axis within the guide the second cam surface transfers a force tending to retract the pin from engagement with the implement.

24. The assembly of claim 23 wherein the second cam surface is a generally oblique surface defined upon a portion of the guide.

25. An assembly for selectively coupling an implement to a loader, said assembly comprising:

a pin slidably supported upon a guide carrier;

an insert attached to the pin;

a first cam surface engaging the insert so that as the pin is rotated in a first direction the first cam surface transfers a force tending to axially extend the pin into engagement with the implement; and a second cam surface engaging the insert so that as the pin is rotated in a second direction opposite the first direction about its axis within the guide the second cam surface transfers a force tending to retract the pin from engagement with the implement.

* * * * *